US005307945A

United States Patent [19]

Hidding et al.

[11] Patent Number: 5,307,945

[45] Date of Patent: May 3, 1994

[54] CLOSURE

[76] Inventors: Walter E. Hidding, 367 A Woodrock Rd., Barrington Hills, Ill. 60010; Douglas J. Hidding, 801 E. Lake Shore Dr., Barrington, Ill. 60010; Robert D. Hidding, 925 Harper Dr., Algonquin, Ill. 60102

[21] Appl. No.: 916,815

[22] Filed: Jul. 20, 1992

Related U.S. Application Data

[63] Continuation-in-part of Ser. No. 902,170, Jun. 26, 1992.

[51] Int. Cl.[5] ..... B65D 41/04

[52] U.S. Cl. ..... 215/329; 215/256; 215/305; 215/337; 215/344; 220/296

[58] Field of Search ..... 215/252, 253, 254, 256, 215/295, 305, 329, 332, 337, 341, 344, 354; 220/260, 293, 296, 298

[56] References Cited

U.S. PATENT DOCUMENTS

| | | | |
|---|---|---|---|
| 3,527,372 | 9/1970 | Manning | 220/296 |
| 3,901,404 | 8/1975 | Feldman | 215/256 |
| 4,131,212 | 12/1978 | Rumball | 215/252 |
| 4,687,114 | 8/1987 | Crisci | 215/256 |

*Primary Examiner*—Allan N. Shoap
*Assistant Examiner*—Nova Stucker
*Attorney, Agent, or Firm*—David I. Roche

[57] ABSTRACT

An injection molded threaded cap for use with containers of varying dimensions. The cap of the present invention includes a cover from which depends an integral plug. An auxiliary sealing ring is disposed at the outside base of the plug to compensate for differences between the diameter of the plug and the diameter of the opening to be sealed by the cap. To prevent doming of the cover of the cap, the underside of the cover has shrinkage resistance formations which provide the cap with structural resistance to the effects of shrinkage. The cap of the present invention further includes a ratchet ring having ratchet teeth designed to enhance the tamper-evidency of the frangible ratchet ring. In an alternative embodiment, the cap includes a thread form which reduces the amount of rotation required to install the cap onto a bottle neck. The thread form includes thread segments which result in less resin being used to form the cap and which results in the formation of an unthreaded area at the base of the inside surface of the skirt of the cap. The unthreaded area facilitates the initial engagement of the cap and the bottle neck. The alternative embodiment also includes a spline arrangement which provides the cap with an anti-stripping feature.

6 Claims, 3 Drawing Sheets

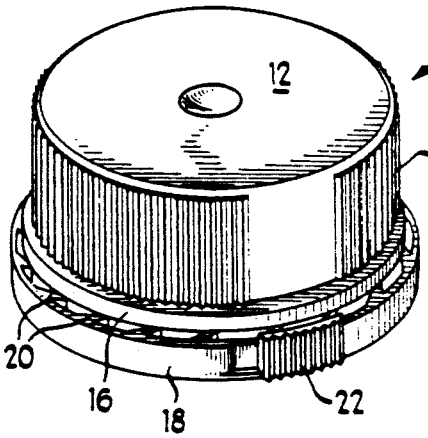
Fig 1
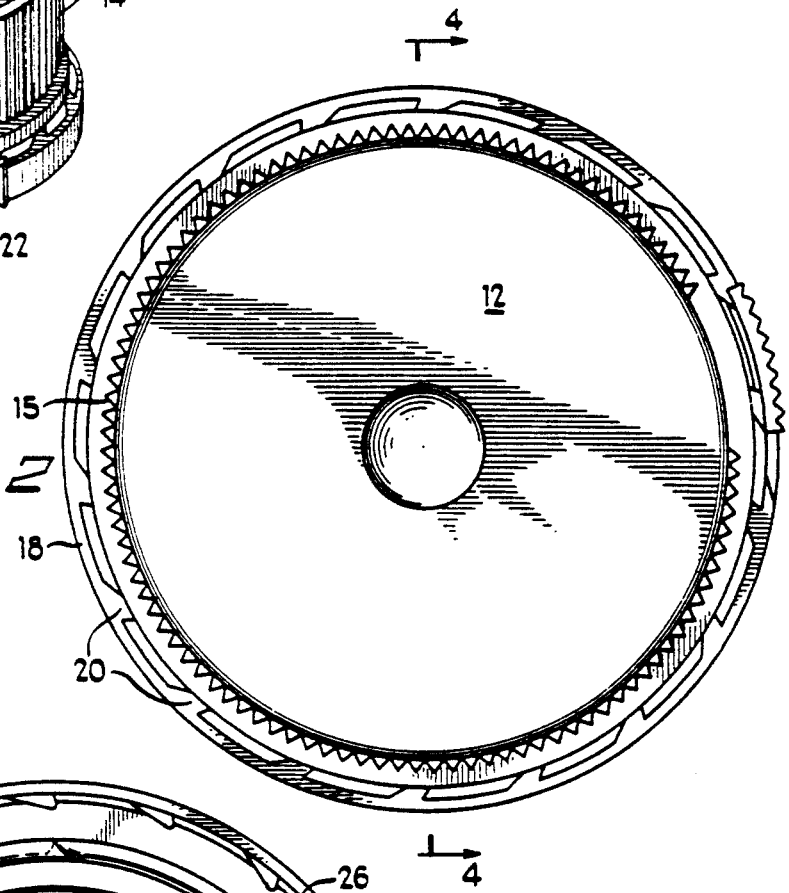
Fig 2
Fig 3
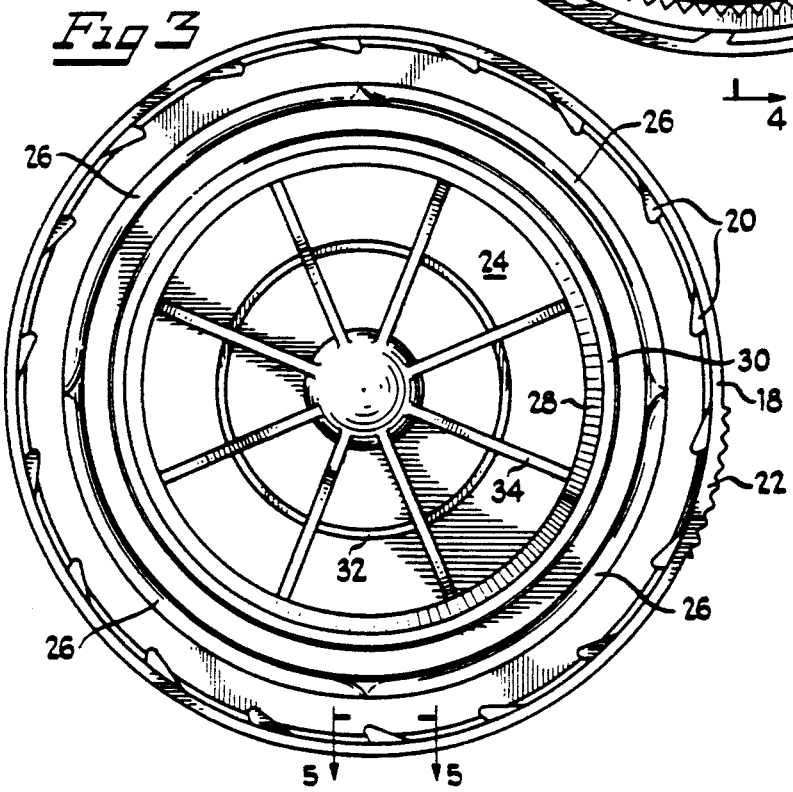

CLOSURE

This is a continuation-in-part of application Ser. No. 902,170, filed Jun. 26, 1992.

BACKGROUND AND SUMMARY OF THE INVENTION

The present invention relates to closure devices, and in particular, relates to injection molded caps for containers which hold liquid, such as milk.

Injection molded caps for blow molded milk bottles have been used for many years. Generally, two types of caps are available, push-on caps and thread-on caps. Push-on caps are installed by aligning the cap with the opening of a container and simply applying an axial force to the top of the cap. Thread-on caps generally require that the cap and container be aligned and that a rotative force be applied to the cap. In some cases, threaded caps, if carefully designed in conjunction with the container to which it is applied, can be made so that the rotative force required to install the cap is minimized or even eliminated. These kinds of injection molded caps are often made with low density polypropylene, a common material used in injection molding.

One of the problems associated with injection molded caps relates to dimensional stability. Polypropylene and other injection moldable materials tend to shrink when they are cooled. The amount of shrinkage is difficult to quantify, and depends on factors such as temperature, the presence or absence of additives such as pigments, the configuration of the product, and other factors. Another aspect of dimensional stability relates to the deformability of the cap at the time it is ejected from the mold. When the cap is still warm after being formed in the mold, forces required to eject the cap can cause deformation of the cap. In some cases, this results in permanent changes in the shape of the product.

Another problem arising from the use of plastic caps and blow molded bottles relates to the seal which must be created between these two components. The imprecise nature of blow molding requires that cap designs be forgiving. Caps must be designed for a wide range of bottle neck shapes, since it is difficult to blow mold containers within tight tolerances.

The problem of matching a blow molded bottle neck with an injection molded cap manifests itself both with respect to the sealing of the two components and with respect to the formation of a tamper-evident connection between the two components. For example, plug-type caps have a downwardly depending plug formed on the underside of the cap. The plug is intended to seal against the inner edge of a lip formed at the top of a container. If the plug of the cap shrinks and the diameter of the container neck at the lip does not properly match the shrunken size of the plug, an effective seal may not be possible. Similarly, many threaded caps include a ratchet ring formed at the lower periphery of the cap. The ratchet ring engages matching ratchet teeth formed on a bottle neck. If the dimensional stability of the components is not sufficient, the tamper-evidency provided by the ratchet ring will not be accomplished.

A further problem arising from the use of plastic caps and blow-molded bottles relates to the automated installation of such caps onto the blow-molded bottles. The installation process involves the loose placement of a cap onto a container neck. Such loose placement occasionally results in a "cocked" cap, which in the next step of installation can result in improper engagement between the tightening tool and the cap or cross-threading of the threads of the cap and the container neck. In these instances, the capping operation can be disrupted, requiring the attention of an operator.

It is therefore an object of the present invention to provide a cap with improved dimensional stability.

Another object of the present invention is to provide a cap in which the effects of shrinkage are reduced.

Yet another object of the present invention is to provide a cap having improved sealing characteristics with respect to bottle containers which are manufactured to relatively loose tolerance requirements.

Still another object of the present invention is to provide an improved tamper-evident cap.

A further object of the present invention is to provide a tamper-evident threaded cap with an improved ratchet ring which prevents removal of the cap unless the ratchet ring has previously been removed.

A further object of the present invention is to provide a threaded cap which reduces the likelihood of disruptions in an automatic capping operation.

Another object of the present invention is to provide a cap for a threaded container in which the amount of rotation required to secure and remove the caps is reduced.

Yet another object of the present invention is to provide a cap which can be produced with less resin than other caps.

These and other objects of the present invention are achieved with a threaded cap which is comprised of a generally flat circular cover with a depending skirt extending from the periphery of the cover. At the bottom of the skirt, a ratchet ring is frangibly connected to the skirt. The ratchet ring includes a plurality of inwardly directed ratchet teeth. The underside of the cover includes various formations which tend to resist deformation of the cap which tends to occur as a result of shrinkage of the material comprising the cap. The cap includes a sealing plug and an auxiliary sealing ring disposed at the outside base of the sealing plug. The auxiliary sealing ring creates a seal against the top surface of a container neck, and will create a seal even if the sealing plug does not fit tightly against the inside edge of the container neck. The ratchet teeth on the tamper-evident ratchet ring are shaped to enhance the locking action of the teeth. The abutting face of each tooth is sloped so that the bottom edge of the tooth is offset with respect to the upper part of the tooth in the direction of unscrewing the cap.

In an alternative embodiment of the invention, the threads of the cap are generally disposed on the upper portion of the inside surface of the skirt of the cap. This creates an unthreaded section on the lower portion of the inside surface of the cap which assists in alignment of the cap and reduces the tendency of the caps to assume an improper position prior to being tightened. In the alternative embodiment, the cap has a thread configuration comprising four thread segments, each of which occupies a discrete circumferential section of the inside surface of the cap. The beginning of one thread is separated from the end of the adjacent thread by about 5 degrees. The separation of the thread segments creates vertically unthreaded areas which allow for circumferential expansion of the cap to accommodate variation in the relative size of the cap and various container necks.

BRIEF DESCRIPTION OF THE DRAWINGS

The objects and advantages of the present invention will be better understood by reading the following specification read in conjunction with the accompanying drawings wherein:

FIG. 1 is a perspective view of a cap of the present invention;

FIG. 2 is a top view of the cap shown in FIG. 1;

FIG. 3 is a bottom plan view of the cap shown in FIGS. 1 and 2;

DETAILED DESCRIPTION OF THE INVENTION

Figure 4:
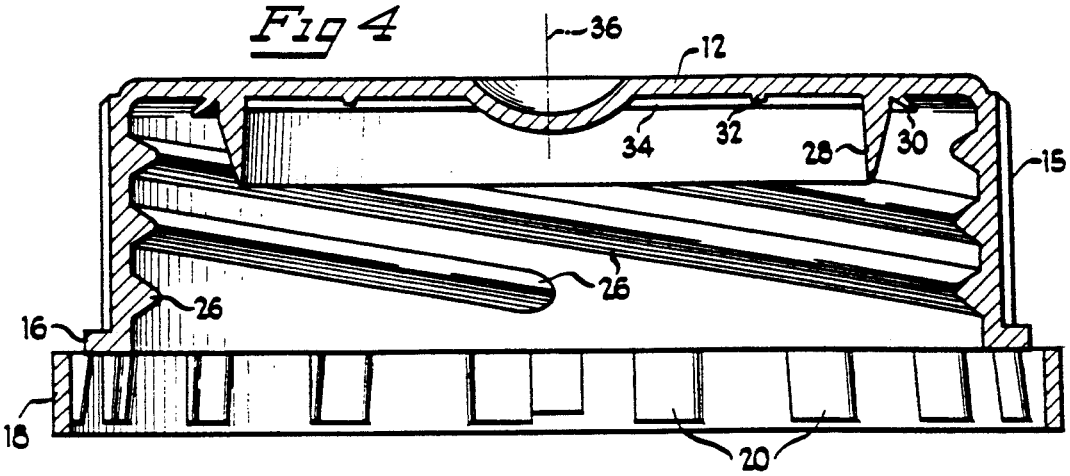
FIG. 4 is a cross-sectional view taken along line 4—4 of FIG. 2.

FIGS. 1 and 2 generally depict the outside of a cap 10. The cap 10 is comprised of a cover 12 and a depending skirt 14 with knurls 15 formed on the outside surface thereof. A bottom flange 16 is formed at the bottom of the skirt, and a ratchet ring 18 is frangibly connected to the bottom flange 16. The ratchet ring 18 includes a plurality of ratchet teeth 20, and a pull-tab 22.

A smooth section 17 of the outside surface of the skirt 14 has no knurls. The smooth section 17 has a width about equal to the width of the pull-tab 22, and extends generally the full height of the skirt 14. The unknurled area 17 serves to clearly identify the location of the pull-tab 22, since the pull-tab 22 itself has a low profile and blends somewhat with the rest of the ratchet ring 18.

FIG. 3 shows the underside 24 of the cover 12. Four distinct threads 26 are formed on the inside surface of the skirt 14. A plug 28 and an auxiliary sealing ring 30 are also formed on the underside 24 of the cover 12.

Caps generally, and threaded caps in particular, tend to shrink most where there is substantial differential in volume of plastic material. Caps which are injection molded tend to shrink in such a way as to deform an initially flat cover 12 into a dome-shaped surface. Significant volume of material is required to form threads which are sufficiently strong to hold the cap 10 in place. The cover 12, on the other hand, needs only to have sufficient thickness to withstand puncturing forces. The shrinkage of the cap 10 to form a dome ("doming") creates problems as it relates to dimensional stability and sealing effectiveness, and sometimes causes problems relating to the affixing of a label on the top of the cover 12. For example, radially inward shrinkage will tend to reduce the outside diameter of the plug 28. To reduce the effects of shrinkage, the cap 10 has means for limiting the doming of the cover 12. A circumferential rib 32 is disposed about midway between the center of the cap 10 and the plug 28. Eight radial ribs 34 extend from the center of the cap 10 to the plug 28. The circumferential rib 32 and radial ribs 34 provide the cover 12 with structural integrity sufficient to withstand the tendency for the cover 12 to assume a domed shape. In addition, by providing the cover 12 with additional volume of plastic material, the differential in material volume between the cover and the skirt is reduced, which tends to further reduce the distorting effects of shrinkage.

Figure 6:
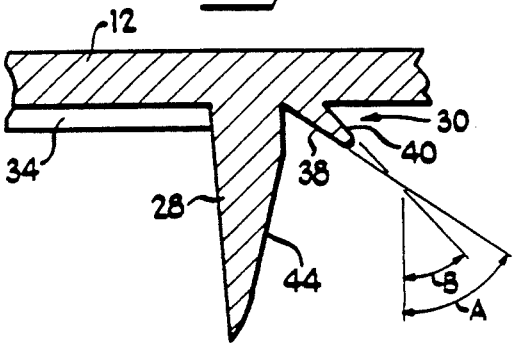
FIG. 6 is an enlarged cross-sectional view of a plug and auxiliary sealing ring of the present invention.

FIGS. 4 and 6 more clearly show the location and configuration of the auxiliary sealing ring 30. The plug 28 is a generally circumferentially continuous formation integrally connected to the underside 24 of the cover 12. The auxiliary sealing ring 30 is also circumferentially continuous, and extends downwardly and outwardly from the base of the plug 28. Both the plug 28 and the auxiliary sealing ring 30 are disposed about the central axis 36 of the cap 10. The auxiliary sealing ring 30 is a thin flexible ring designed to engage the top surface of a container neck finish. The lower surface 38 makes an angle A with a line V, which is parallel to the axis 36, of about 55°. The upper surface 40 makes an angle B of about 45° with respect to the line V. The rounded tip 42 of the auxiliary sealing ring 30 has a radius of about 0.005 inches, and the average thickness of the auxiliary sealing ring 30 is about 0.015 inches. The plug 28 has an outer surface 44 which is frustoconical about the axis 36. Similarly, the upper and lower surfaces 40 and 38 respectively of the auxiliary sealing ring 30 are also frustoconical about the axis 36. It is important in order to achieve proper sealing that the surfaces which comprise the plug 28 and the auxiliary sealing ring 30 be frustoconical and concentric about the central axis of the cap 10.

Figure 5:
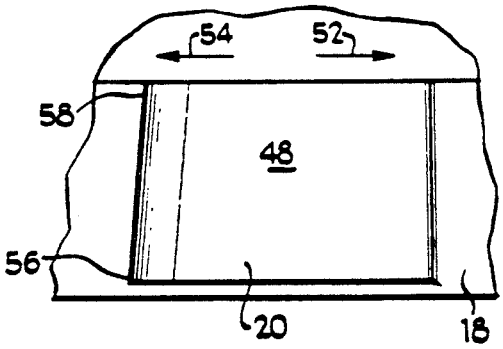
FIG. 5 is an enlarged elevational view taken along line 5—5 of FIG. 3.
Figure 7:
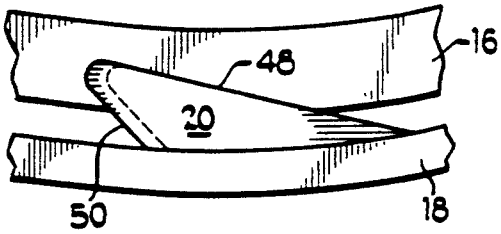
FIG. 7 is an enlarged end view of the tooth shown in FIG. 5.

FIGS. 5 and 7 more clearly show the configuration of the ratchet teeth 20. Each tooth 20 is comprised of a ramp surface 48 and an abutting surface 50. FIG. 7 is a bottom view of the tooth 20 shown in FIG. 5. Arrow 52 indicates the direction in which the cap 10 moves when the cap 10 is installed or tightened. Arrow 54 indicates the direction required to unscrew the cap 10. The abutting surface 50 of the tooth 20 is sloped in such a way that the lower edge 56 of the tooth 20 is offset with respect to the upper portion 58 of the tooth 20 in the direction of unscrewing the cap 10. As a result, as the tooth 20 engages a mating ratchet tooth on a bottle neck, the bottom edge 56 of the tooth 20 will engage the mating ratchet tooth first. The sloping nature of the surface 50 will enhance the grouping engagement of the tooth 20, and will resist unintended camming or slippage of the teeth 20 on the cap 10 relative to the matching ratchet teeth on the bottle neck.

Again, because of the difficulty in maintaining tolerances when blow molding plastic bottles, it is important to design caps so that they can accommodate bottle necks of varying dimensions. This is particularly the case since bottle caps are often made in a relatively controlled manufacturing facility, whereas blow molded containers are often made on-site in dairies and other bottling facilities where it is difficult to carefully control dimensions of the containers and where blow molding is done without benefit of experienced operators. The shrinkage control, sealing and tamper-evident features of the present invention are intended to overcome the difficulty of ensuring an effective seal between an injection molded cap and a blow molded bottle.

Figure 9:
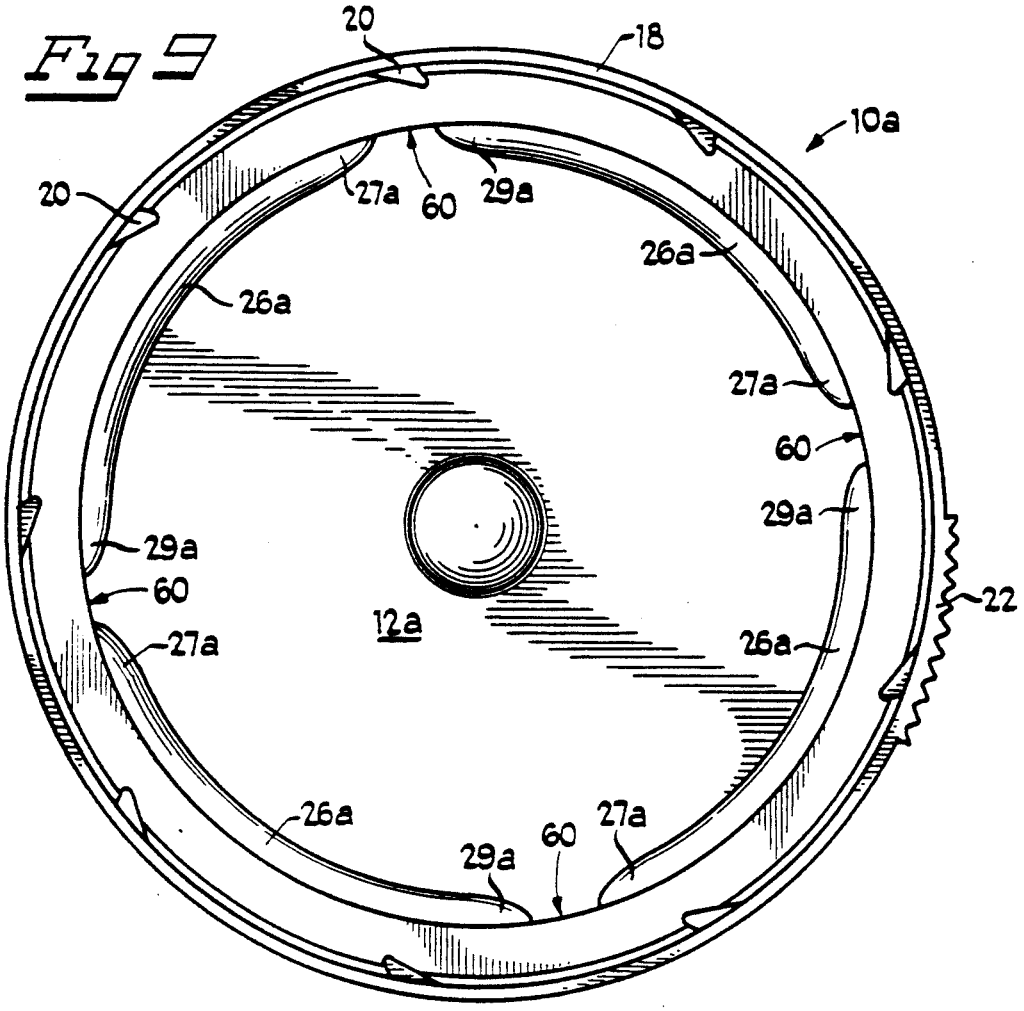
FIG. 9 is a bottom plan view of the cap shown in FIG. 8.
Figure 8:
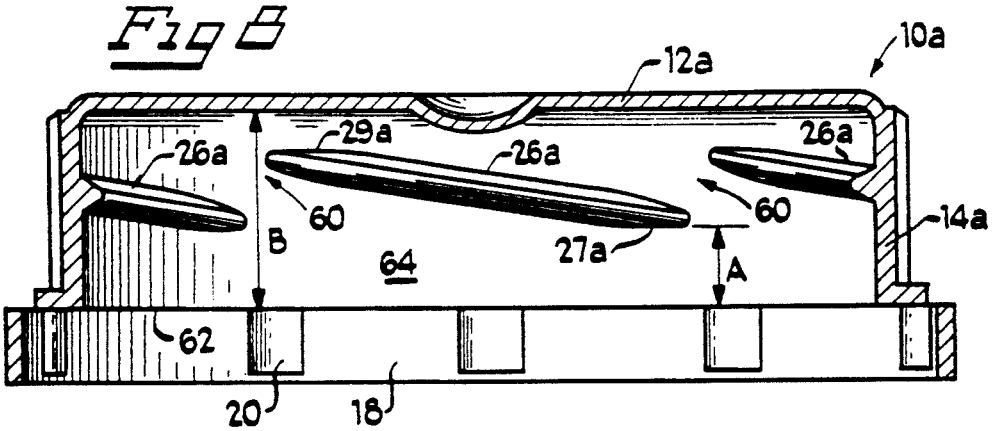
FIG. 8 is a sectional view of an alternative embodiment of the invention.
Figure 10:
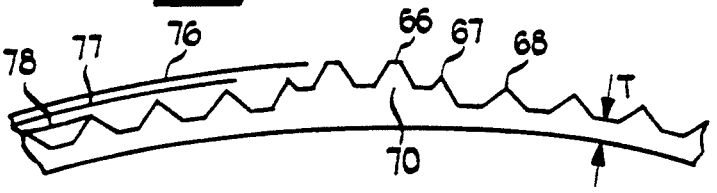
FIG. 10 is an enlarged plan view of an edge of the cap shown in FIGS. 8 and 9.

FIGS. 8, 9 and 10 show an alternative embodiment of the present invention. The embodiment of FIGS. 8, 9 and 10 differs in two respects from the embodiment of FIGS. 1 through 7. First, the alternative embodiment does not contain a plug, although a plug could be used with the embodiment of FIGS. 8, 9 and 10. The absence of a plug means that the cap of FIGS. 8, 9 and 10 is one which could be used with a foil liner having a heat sensitive surface which can be heated into sealing engagement with the upper surface of a container neck by induction heating. The second and main difference between the embodiment of FIGS. 8, 9 and 10, and that of FIGS. 1 through 7, is the thread form. In describing and referring to the cap in FIGS. 8, 9 and 10, a letter "a" has been added to the reference numerals to indicate a feature which is characteristic of the alternative embodiment. Where features of the alternative embodiment of FIGS. 8, 9 and 10 are the same as the embodiment of FIGS. 1 through 7, the same reference numerals are used.

FIG. 8 shows a cap 10*a* with discrete and relatively short thread segments 26*a* which are separated by unthreaded areas 60 which extend from the cover 12*a* to the bottom edge 62 of the skirt 14*a*.

The relatively short helical length of the thread segments 26*a*, together with the placement of the thread segments 26*a* generally on the upper half of the inside surface of the skirt 14*a*, leaves a relatively large, unthreaded section 64 beneath each of the thread segments 26*a*. The advantage of this configuration is that initiation of threaded engagement ("pick-up") between the cap and the bottle neck is facilitated. It has been found that by providing an unthreaded section 64 of substantial axial length, caps are less likely to assume a "cocked" position when first placed on a bottle neck. Another advantage of the reduced helical length of the thread segments 26*a* is that less rotation is required to both tighten and untighten the cap.

In the thread form shown in FIGS. 8 and 9, the upper ends 29*a* of each thread segment 26*a* are at approximately the same elevation. Similarly, the lower ends 27*a* of each of the thread segments 26*a* are at approximately the same elevation on the inside surface of the skirt 14*a*. The distance A represents the distance between the lower ends 27*a* of the segments 26*a* and the bottom edge 62 of the skirt 14*a*. The distance B represents the distance between the cover 12*a* and the bottom edge 62. An effective ratio of the axial extent A of the unthreaded section 64 to the overall length B of the inside surface of the skirt 14*a* is about 0.43. This is arrived at by leaving a length of about 0.16 inches between the lower end 27*a* of each of the thread segments 26*a* and the bottom edge 62 on a cap having an overall inside skirt length of about 0.372 inches. Such a ratio provides caps with the ability to align themselves on a container neck to prevent or at least reduce the likelihood of misalignment.

As can be seen in FIG. 9, each of the thread segments 26*a* is separated by an unthreaded area 60. The unthreaded areas 60 provide the skirt 14*a* with increased circumferential flexibility. This circumferential flexibility allows the cap to accommodate neck sizes which vary from one bottle to the next. The circumferential extent of the unthreaded areas 60 need only be about 5 degrees. On a four-thread cap, leaving four unthreaded areas 60 of about 5 degrees, results in the thread segments 26*a* having a circumferential extent of about 85 degrees each. Such an arrangement has been found to result in an effective cap which reduces the incidence of misalignment, and which requires a reduced amount of rotation in order to achieve tightening. A further advantage of the thread design of the cap shown in FIGS. 8 and 9 is the fact that less resin is required to form the cap. Reducing the amount of resin used in a cap to thereby reduce cost is generally known as "light weighting". The smaller helical length of the thread means that less resin is required to form the threaded portion of the cap.

FIG. 10 shows the configuration of the splines 66, 67 and 68, which extend vertically on the outside surface of the skirt 14*a*. The spline configuration includes a series of adjacent triangularly shaped splines 68 which extend outwardly to define a diameter 78. Between each spline 68 is an area of the skirt 14*a* having the smallest thickness T. The thickened area 70 of the skirt 14*a* contains the splines 67, which extend outwardly to define a diameter 77, and splines 66 which extend outwardly to define diameter 76. On the cap 10*a*, there are twelve thickened areas 70 around the periphery of the cap. The caps described herein are generally installed by means of automated capping lines which include tightening tools which engage the outside surface of the caps and rotate the caps into threaded engagement with a threaded container neck. The varying diametrical dimensions of the splines 66, 67 and 68 provide the cap with the ability to be engaged by tightening tools of various diameters. The variation among tightening tools may be the result of wear or other factors, such as differences resulting from manufacturing techniques employed by various suppliers. When high density polyethylene is used to form the cap, the thickness T of the skirt 14 can be light weighted to a dimension as small as about 0.03 inches.

The presence of the splines of varying diameter compensates for the absence of material in the skirt of the cap which may be the result of light weighting the cap. Radial pressure applied to the outermost splines 66 by a tightening tool when the cap is inserted into such tool is transferred radially through the skirt 14*a* to the threads 26*a*, thereby improving the engagement of the threads 26*a* with the corresponding threads on the container neck. The improved thread engagement afforded by the splines 66 assists in preventing stripping of the cap when it is initially being tightened onto a container neck.

While a specific embodiment of the invention has been shown and described, it will be apparent to those skilled in the art that numerous alternatives, modifications, and variations of the embodiment shown can be made without departing from the spirit and scope of the appended claims.

We claim:

1. A cap comprising a generally flat cover portion, a skirt depending from the periphery of said cover, said skirt having a generally cylindrical shape with an inside surface and an outside surface, said cover forming a closed end of said skirt and said skirt having an open end opposite said closed end, thread means on said inside surface for holding said cap into engagement with a threaded neck of a container, said thread means comprising a plurality of thread segments, each of said segments extending along concentric helical paths at different locations on said inside surface of said skirt, and each of said segments having lower extremities at generally equal elevations on said skirt, and each of said segments having upper extremities at generally equal elevations on said skirt, said thread segments being generally disposed on approximately the upper half of said skirt, said inside surface of said skirt having an unthreaded section extending along generally the lower half of said inside surface, the sum of the circumferential extents of said thread segments being less than the circumference of said inside surface of said skirt, vertical unthreaded areas extending between said segments from the closed end to the open end of said skirt, said thread segments being four in number and each segment extending circumferentially on said inside surface of said skirt for about 85 degrees and each vertical unthreaded area having a circumferential extent of about 5 degrees.

2. A cap comprising a generally flat cover portion, a skirt depending from the periphery of said cover, said skirt having a generally cylindrical shape with an inside surface and an outside surface, said cover forming a closed end of said skirt and said skirt having an open end opposite said closed end, thread means on said inside surface for holding said cap into engagement with a threaded neck of a container, said thread means comprising a plurality of thread segments, each of said segments extending along concentric helical paths at different locations on said inside surface of said skirt, and each of said segments having lower extremities at generally equal elevations on said skirt, and each of said segments having upper extremities at generally equal elevations on said skirt, said thread segments being generally disposed on approximately the upper half of said skirt, said inside surface of said skirt having an unthreaded section extending along generally the lower half of said inside surface, said skirt including splines on said outer surface, said splines including anti-stripping means for assisting in the prevention of stripping of said thread means with respect to threads of a container neck during a tightening operation, said cap including first and second sets of splines, one of said sets comprising said anti-stripping means and defining a diameter greater than a diameter defined by the other of said set of splines.

3. A cap in accordance with claim 2 wherein:

the ratio of the axial length of said unthreaded section to the overall length of said inside surface of said skirt is about 0.43.

4. A cap in accordance with claim 2 wherein:

said first and second set of splines is each comprised of twelve groups of spline sections, the spline sections of each of said sets being alternately disposed on the periphery of said outer surface.

5. A cap comprising a generally flat cover portion, a skirt depending from the periphery of said cover, said skirt having a generally cylindrical shape with an inside surface and an outside surface, said cover forming a closed end of said skirt and said skirt having an open end opposite said closed end, thread means on said inside surface for holding said cap into engagement with a threaded neck of a container, and a tamper evidencing ring connected to the open end of said skirt by frangible connections, said ring including a plurality of rachet teeth which are capable of meshing with a matching set of rachet teeth on a container neck, at least one of said rachet teeth of said ring having first and second tooth surfaces, said first tooth surface forming a ramp to facilitate placement of said cap on a container without breaking said frangible connections, said second tooth surface forming an abutment, said second tooth surface sloping over a substantial portion of its length with respect to a plane defined by the open end of said skirt, such that portions of said second surface nearer said open end of said skirt are offset with respect to portions nearer said closed end of said skirt.

6. A cap in accordance with claim 5 wherein:

said second tooth surface makes an angle of about 85 degrees with respect to said plane.

* * * * *